US005129127A

United States Patent [19]

Hamatani

[11] Patent Number: 5,129,127

[45] Date of Patent: Jul. 14, 1992

[54] SLIDE FASTENER STRINGER

[75] Inventor: Tsutomu Hamatani, Namerikawa, Japan

[73] Assignee: Yoshida Kogyo K. K., Tokyo, Japan

[21] Appl. No.: 696,589

[22] Filed: May 7, 1991

[30] Foreign Application Priority Data

May 18, 1990 [JP] Japan ..... 2-52342

[51] Int. Cl.[5] ..... A44B 19/12

[52] U.S. Cl. ..... 24/394; 24/393

[58] Field of Search ..... 24/394, 393, 395

[56] References Cited

U.S. PATENT DOCUMENTS 3,783,476 1/1974 Frohlich ..... 24/394
3,849,842 11/1974 Yoshida ..... 24/394
3,855,671 12/1974 Fujisaki ..... 24/394
3,919,744 11/1975 Kandou ..... 24/395
4,034,444 7/1977 Moertel ..... 24/394
4,041,577 8/1977 Matsuda ..... 24/393
4,321,733 3/1982 Yoshida ..... 24/395

FOREIGN PATENT DOCUMENTS 62-171912 10/1987 Japan .

*Primary Examiner*—Victor N. Sakran
*Attorney, Agent, or Firm*—Hill, Van Santen, Steadman & Simpson

[57] ABSTRACT

A slide fastener stringer comprises a support tape having a foundation fabric strip either woven or knitted which is coated on both sides with a coat of elastomeric or rubberry material and a row of coupling elements mounted on an inner longitudinal edge of the tape. The coat is reduced in thickness along the inner edges of the tape to alleviate the tension of sewn seams thereat which secure the coupling elements to the tape.

5 Claims, 2 Drawing Sheets

SLIDE FASTENER STRINGER

BACKGROUND OF THE INVENTION

1. Field of the Invention

This invention relates generally to slide fasteners or zippers and more particularly to a slide fastener stringer having coupling elements secured to a coated support tape.

2. Prior Art

Various slide fastener stringers are known comprising a base woven or knitted tape which is coated on both sides with a cover layer such as of rubber, elastomeric materials and the like.

A typical relevant prior art is disclosed in Japanese Utility Model Laid-Open Publication No. 62-171912 in which a stringer tape is coated with an elastomeric material such as vinyl chloride and has a row of coupling elements sewn onto one of its longitudinal edge portions which are substantially as thick as the remaining web portion of the tape. The coupling elements may thus be firmly secured in place on the tape by virtue of the repulsive or bounce-back action of the elastomeric coats on compression by the sewing pressure. However, the coated layers are susceptible to debilitation of their repulsive force in use over extended periods of time, resulting in reduced tension of the sewn seams and hence loosened coupling elements, leading to malfunction of the slide fastener. This problem is pronounced in the case where a slide fastener having such coated stringer tapes is subjected to severe lateral pull as when applied to a fully packed bag or the like.

SUMMARY OF THE INVENTION

With the foregoing difficulties of the prior art in view, the present invention seeks to provide a slide fastener stringer having a coated supported tape on which coupling elements are secured with increased positional stability to maintain their proper interengaging and disengaging operation over extended periods of time in use of a slide fastener to which the stringer is applied.

The above and other features and advantages of the invention will become apparent from the following detailed description taken in conjunction with the accompanying drawings which illustrate by way of example some preferred embodiments. Like reference numerals refer to like or corresponding parts throughout the several views.

According to the invention there is provided a slide fastener stringer which comprises a support tape having a foundation fabric strip embedded in a coat of elastomeric material or rubber having an upper layer and a lower layer and a row of coupling elements having an upper leg portion and a lower leg portion and mounted on an inner longitudinal edge portion of the support tape, the longitudinal edge portion being reduced in thickness and adapted to mount thereon the row of coupling elements by means of sewn seams.

DETAILED DESCRIPTION OF THE INVENTION

Figure 1:
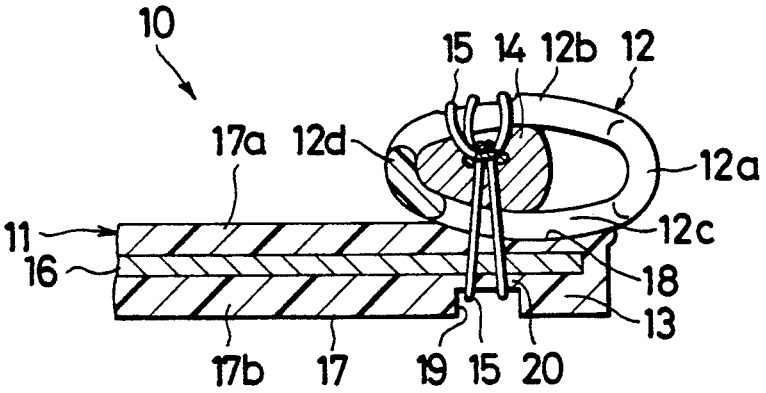
FIG. 1 is a transverse cross-sectional view on enlarged scale of a slide fastener stringer provided in accordance with a first embodiment of the invention.

Referring to the drawings and firstly FIG. 1, there is shown a slide fastener stringer 10 according to a first embodiment of the invention, which stringer comprises a support tape 11 and a row of coupling elements 12 in the form of a continuous helical structure secured to and along one or inner longitudinal edge portion 13 of the support tape 11. In practice, a pair of these identical stringers 10 are used to constitute a slide fastener which is opened and closed by a slider S (FIG. 3) movable along the rows of coupling elements 11 to take the latter into and out of interengagement in a manner well known in the art. Each of the coupling elements 12 has a coupling head portion 12*a*, an upper leg portion 12*b* and a lower leg portion 12*c* extending from the head portion 12*a* substantially in superimposed relation and merging at a heel portion 12*d*. A reinforcing core 14 extends longitudinally through the row of coupling elements 12 and between the upper and lower leg portions 12*b*, 12*c* along the inner edge 13 of the support tape 11 and is adapted to hold the coupling elements 12 in place against crushing when they are affixed by sewing threads 15 to the tape 11. The support tape 11 consists of a foundation woven or knitted fabric strip 16 coated with or embedded in a coat 17 of elastomeric material or rubber. An upper layer 17*a* of coat 17 is relatively thin and has a recessed surface 18 extending longitudinally along the inner edge 13 of the tape 11, the recessed surface 18 being preferably contoured to conform with the contour of the lower leg portion 12*c* so as to ensure proper sewing position of the row of coupling elements 12. A lower layer 17*b* of the tape 11 is relatively thick and thicker than the upper layer 17*a* and has a groove 19 extending longitudinally along the inner edge 13 of the tape 11 in opposed relation to the recessed surface 18 of the upper layer 17*a* and adapted to receive and retain the sewing threads 15. The provision of the recessed surface 18 and the groove 19 in the longitudinal inner edge portion 13 of the support tape 11 results in a reduced thickness portion 20 at which row of coupling elements 12 is sewn to the tape 11.

Figure 2:
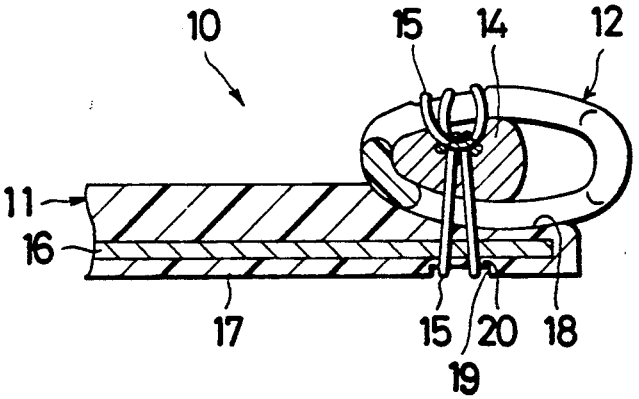
FIG. 2 is a transverse cross-sectional view on enlarged scale of a slide fastener stringer provided in accordance with a second embodiment of the invention.

A slide fastener stringer 10 according to a second embodiment of the invention shown in FIG. 2 is substantially the same as the stringer 10 above described and shown in FIG. 1, except that the upper coated layer 17*a* of the tape 11 is thicker than the lower coated layer 17*b*.

Figure 3:
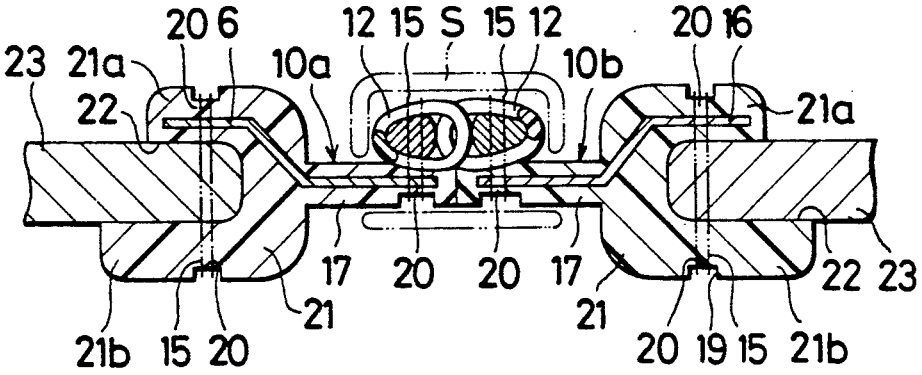
FIG. 3 is a transverse cross-sectional view on enlarged scale of a pair of slide fastener stringers provided in accordance with a third embodiment of the invention, the stringers being shown coupled together by a slider.

A fastener stringer 10 shown in FIG. 3 constitutes a third embodiment of the invention, in which a pair of stringers 10*a*, 10*b* are shown coupled together by the slider S and attached to a garment article. Each of the stringers 10*a* , 10*b* is substantially the same as the stringer 10 of the first embodiment except that the coated layer 17 of the tape 11 has a bifurcated thickened outer edge 21 including an upper grip surface portion 21*a* and a lower grip surface portion 21*b* defining therebetween a cavity 22 extending longitudinally along the tape 11. The cavity 22 is adapted to receive and grip therein the edges 23 of an opening in for example a bag not shown when attaching the slide fastener to the bag by means of sewn seams 15 which are received in the grooves 19 formed in both the upper and lower surfaces of the bifurcated edge portion 21 of the tape. The foundation strip 16 extends in and through the upper coated grip surface portion 21*a*, as presently illustrated, but may extend through the lower coated grip surface portion 21*b* with similar results. The level of the upper surface portion 21*a* of the tape 11 is substantially the same as or somewhat higher than the level of the upper surface of the upper leg portion 12*b* of the coupling element 12 so as to protect the row of coupling elements against injury.

Figure 4:
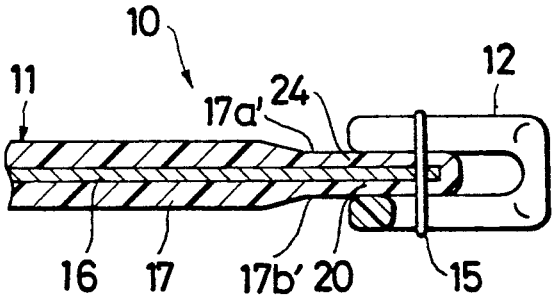
FIG. 4 is a transverse cross-sectional view on enlarged scale of a slide fastener stringer provided in accordance with a fourth embodiment of the invention.

A slide fastener stringer 10 according to a fourth embodiment of the invention shown in FIG. 4 comprises a support tape 11 having a foundation strip 16 embedded in a coated layer 17. The coat 17 has an upper layer 17*a* and a lower layer 17*b*, both layers having their respective inner edge portions 17*a*', 17*b*' reduced substantially equally in thickness to provide an element-receptive mount 24 extending longitudinally along the tape edge 13. The row of meandered coupling elements 12 is mounted astride over the mount 24 and secured in place by sewn seams 15.

In all of the above embodiments of the invention, the support tape 11 has its inner longitudinal edge portion 13 reduced in thickness to an extent necessary to keep the sewn threads or seams 15 thereat from being overly tensioned so as to ensure positional stability of the coupling elements 12 over extended periods of time in use of the slide fastener.

Obviously, various modifications and variations of the present invention are possible in the light of the above teaching. It is therefore to be understood that within the scope of the appended claims the invention may be practiced otherwise than as specifically described.

What is claimed is:

1. A slide fastener stringer which comprises a support tape having a foundation fabric strip embedded in a coat of elastomeric material or rubber having an upper layer and a lower layer and a row of coupling elements having an upper leg portion and a lower leg portion and mounted on an inner longitudinal edge portion of said support tape, said longitudinal edge portion being reduced in thickness and adapted to mount thereon said row of coupling elements by means of sewn seams, wherein said upper layer is provided with a recessed surface extending longitudinally along the edge portion of said tape for receiving the lower leg portion of said coupling element and said lower layer is provided with a groove extending longitudinally in opposed relation to said recessed surface for receiving the sewn seams.

2. A slide fastener stringer according to claim 1 wherein said recessed surface is contoured to conform with the contour of said lower leg portion.

3. A slide fastener stringer according to claim 1 wherein said upper layer is thinner than said lower layer.

4. A slide fastener stringer according to claim 1 wherein said upper and lower layers are reduced substantially equally in thickness along the inner longitudinal edge portion of said tape.

5. A slide fastener string which comprises a support tape having a foundation fabric strip embedded in a coat of elastomeric material or rubber having an upper layer and a lower layer and a row of coupling elements having an upper leg portion and a lower leg portion and mounted on an inner longitudinal edge portion of said support tape, said longitudinal edge portion being reduced in thickness and adapted to mount thereon said row of coupling elements by means of sewn seams, further including a bifurcated outer longitudinal edge portion including an upper surface portion and a lower surface portion defining therebetween a cavity, said foundation strip extending through either of said upper and lower surface portions.

* * * * *